US005123482A

United States Patent [19]

Abraham

[11] Patent Number: 5,123,482

[45] Date of Patent: Jun. 23, 1992

[54] OVAL TUBE HEAT EXCHANGER

[75] Inventor: Anthony W. Abraham, Fort Worth, Tex.

[73] Assignee: Wynn's Climate Systems, Inc., Fort Worth, Tex.

[21] Appl. No.: 791,889

[22] Filed: Nov. 14, 1991

[51] Int. Cl.[5] ..... F28F 9/16

[52] U.S. Cl. ..... 165/173; 29/890.043

[58] Field of Search ..... 165/173, 175, 905; 29/890.043, 890.044

[56] References Cited

U.S. PATENT DOCUMENTS

| | | | |
|---|---|---|---|
| 1,198,307 | 9/1916 | Zimmermann | 165/173 |
| 3,471,178 | 10/1969 | Roe | 29/890.043 X |
| 4,467,511 | 8/1984 | Collgon | 29/890.043 |
| 4,651,821 | 3/1987 | Moranne | 165/175 |
| 4,682,650 | 7/1987 | Potier | 165/173 |

FOREIGN PATENT DOCUMENTS

| | | | |
|---|---|---|---|
| 2229032 | 12/1974 | France | 165/173 |

*Primary Examiner*—Allen J. Flanigan
*Attorney, Agent, or Firm*—Arthur F. Zobal

[57] ABSTRACT

Two plastic seal plates are located between the end of a manifold and the end of a heat exchanger core having oval shaped flow tubes extending through parallel fins. One seal plate has a plurality of spaced apart oval shaped apertures formed therethrough located to tightly receive the ends of the flow tubes. Oval shaped extension tubes extend from one side of said one seal plate from the oval shaped apertures for tightly receiving the ends of the flow tubes. The other seal plate has a plurality of oval shaped apertures formed therethrough for tightly receiving the extension tubes.

1 Claim, 3 Drawing Sheets

OVAL TUBE HEAT EXCHANGER

FIELD OF THE INVENTION

The invention relates to a heat exchanger of the type used for a heater core.

BACKGROUND OF THE INVENTION

In heater cores used in motor vehicles, it is desirable to use oval shaped flow tubes since the heater cores are narrow in width and more surface area can be obtained for the flow tubes if they are oval shaped. Problems have occurred, however, in sealing the ends of the oval tubes to cylindrical ports since conventional swedging is expensive and does not result in a good seal.

SUMMARY OF THE INVENTION

It is an object of the invention to provide a heat exchanger with oval shaped flow tubes with a unique and effective seal means located between one end of the heat exchanger and a manifold for allowing fluid flow between the tubes and ports of the manifold.

The seal means comprises two plastic plates with a first plate having oval apertures and oval extension tubes for tightly receiving the ends of the oval flow tubes. The second plate has a plurality of oval apertures for tightly receiving the extension tubes.

DESCRIPTION OF THE PREFERRED EMBODIMENTS

Figure 4:
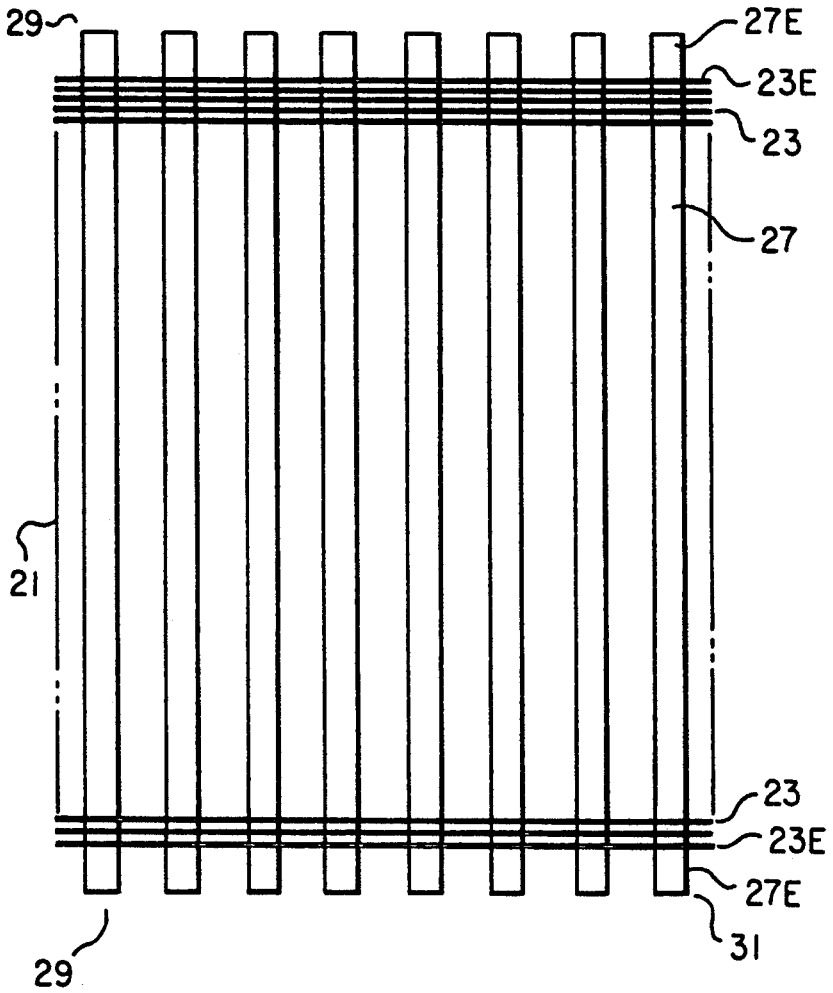
FIG. 4 is a side view shown in partial form of the tubes and fins of the heat exchanger of FIG. 1.
Figure 5:
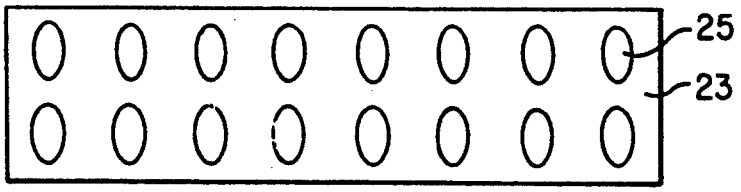
FIG. 5 is a plan view of one of the fins of the heat exchanger of FIGS. 1 and 4.
Figure 6:
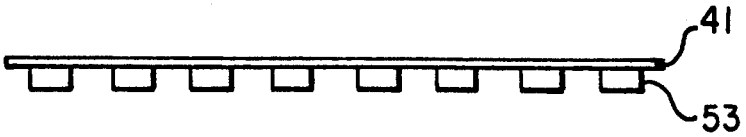
FIG. 6 is a side view of the seal plate shown in the upper position in FIG. 1.

Referring now to the drawings there is illustrated a heat exchanger 21 of a heater core of a motor vehicle such as an automobile. The heat exchanger comprises a plurality of generally parallel rectangular shaped identical aluminum fins 23 each having a plurality of spaced apart oval apertures 25 formed therethrough with oval shaped metal tubes 27 extending through the apertures 25 (See FIG. 4). The tubes 27 may be formed of copper. The apertures 25 are punched through the fins such that one side of each fin will have metal edges extending from the apertures 25 such that as the tubes 27 are pushed through the apertures 25 to form the heater core, the fins 23 will be spaced from and located parallel to each other. In FIG. 4, only the fins at the ends 29 and 31 of the heater core are shown.

At each end 29 and 31 of the heater core there will be located metal end plates 33 and metal manifolds 35U and 35L respectively. The end plates 33 and manifolds 35U and 35L may be formed of brass. The end plates 33 each have a plurality of oval shaped apertures 37 formed therethrough for receiving the ends 27E of the tubes extending beyond the two end fins 23E with the ends 27E of the tubes 27 extending beyond the end plates 33. The two edges of each end plate 33 have bendable tabs 39 for receiving and holding seal plates 41 and 43 and two edges of the manifolds 35U and 35L. The upper manifold 35U has inlet and outlet chamber portions, 45A and 45B separated by a wall 35W with ports 47A and 47B leading thereto respectively. The open ends of one row of tubes 27RI are exposed to chamber portion 45A and the open ends of the other row of tubes 27R2 exposed to chamber portion 45B. The lower manifold 35L has a single chamber 45 with the open ends of all of the tubes 27 exposed thereto. The lower manifold 35L has no inlet and outlet ports. Fluid flow is by way of port 47A, chamber portion 45A, tubes 27RI, chamber 45, tubes 27R2, chamber portion 45B, and port 47B. At each end of the core, the seal plates 41 and 43 provide a seal between the end plate 33, the outside surface of the tube ends 27E and the outer edges of the manifolds 35U and 35L.

The seal plates 41 and 43 are formed of plastic, with plate 43 preferably being formed of fiberglass filled NYLON for strength and plate 41 being formed of a heat resistant plastic such as SANTOPRENE which can be injection molded and hence readily and cheaply formed. The plate 41 has a plurality of spaced apart oval shaped apertures 51 formed therethrough, equal in number to the number of tubes 27 and located to tightly receive the ends 27E of the tubes 27. A plurality of extension tubes 53 extend from one side of plate 41 from the oval apertures 51 respectively for tightly receiving the ends 27E of the tubes 27. The inside of the extension tubes 53 are oval in shape and form a smooth continuation of the apertures 51. The outsides of the extension tubes 53 also are oval shaped (See FIG. 3).

Figure 1:
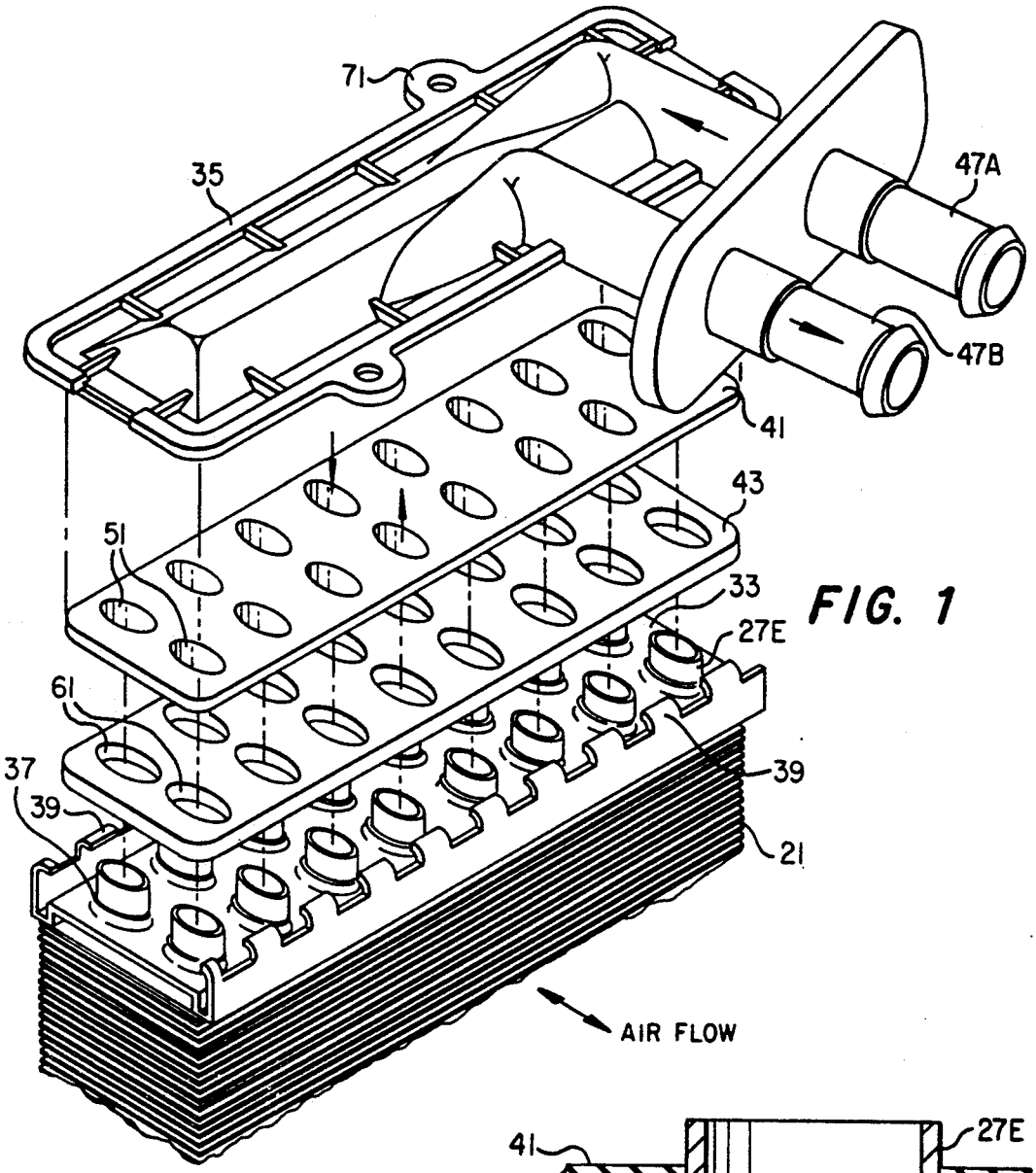
FIG. 1 is an exploded view of a portion of a heat exchanger incorporating the invention.
Figure 2:
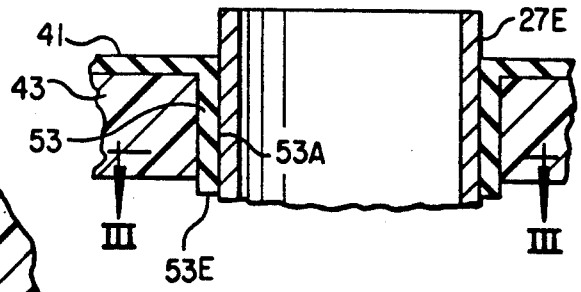
FIG. 2 is a partial cross-section of one of the oval tubes of the heat exchanger and the seal of the invention.
Figure 3:
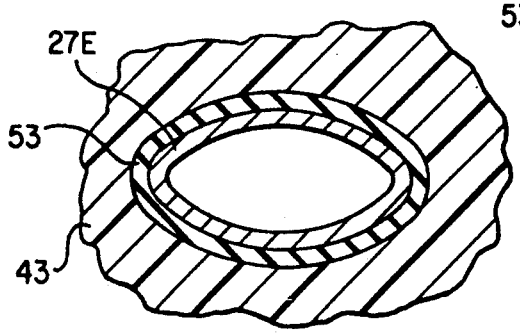
FIG. 3 is a cross section of FIG. 2 taken along lines 3—3 thereof.

The seal plate 43 also has a plurality of oval shaped apertures 61 formed therethrough equal in number to the number of extension tubes 53 for tightly receiving the extension tubes 53 (See FIGS. 1, 3).

Figure 7:
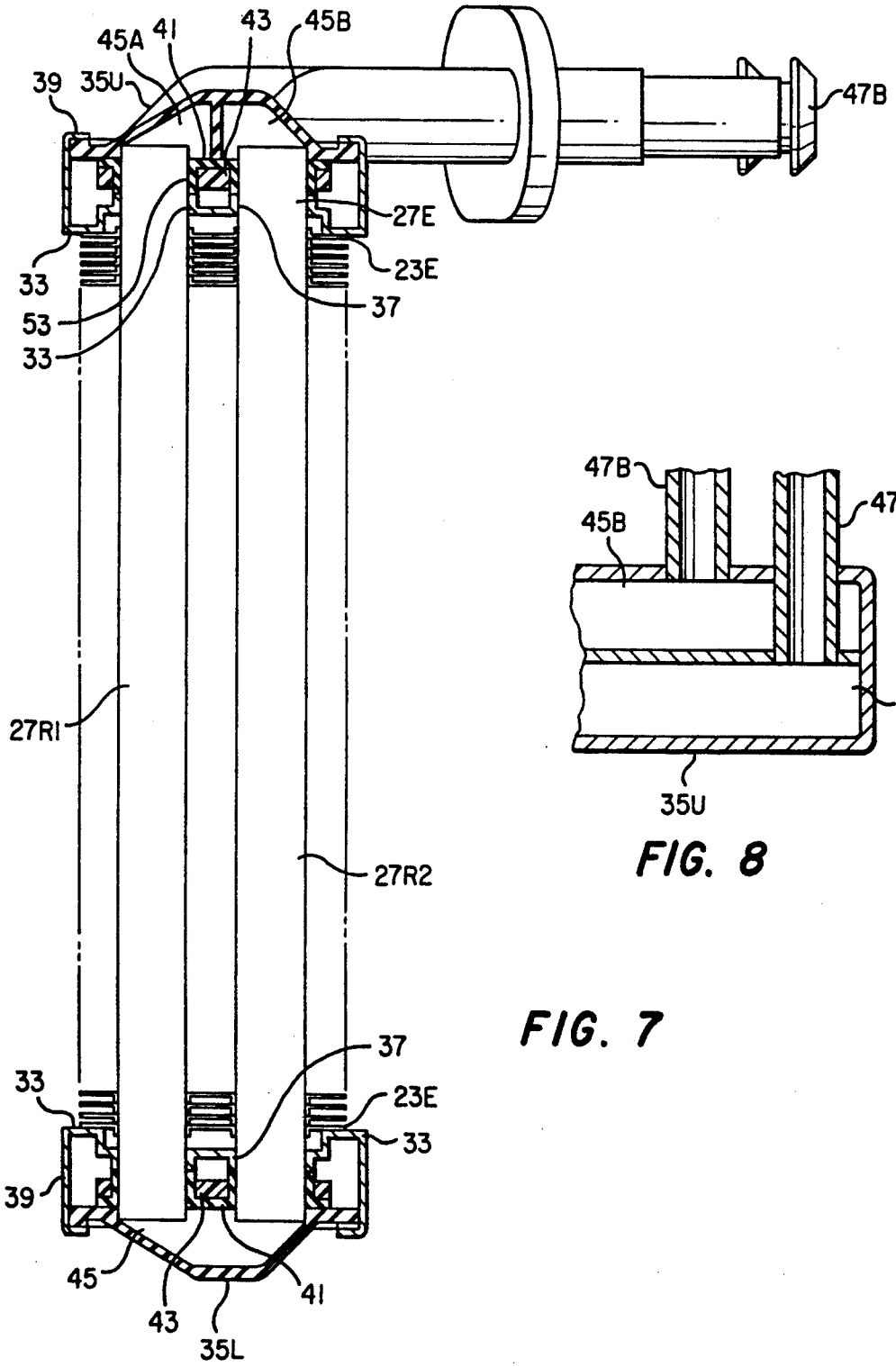
FIG. 7 is a partial cross-sectional side view of the heat exchanger incorporating the invention.
Figure 8:
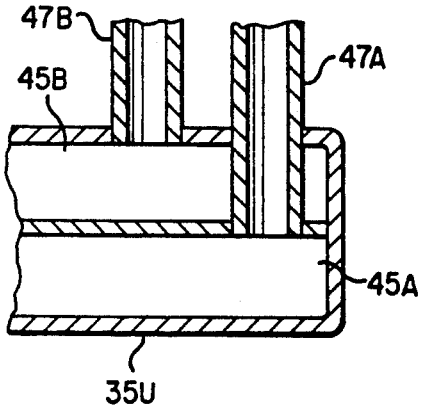
FIG. 8 is a partial cross-section of the upper manifold shown from the underside thereof.

In the assembly process, the upper ends 27E of the tubes 27 are inserted through the apertures 37 of the upper end plate 33. Extension tubes 53 of the upper plate 41 are located in apertures 61 of the upper plate 43 with the two upper plates 41 and 43 engaging each other. If desired, the ends 53E of the extension tubes 53 extending beyond the plate 41 can be formed or compressed against the side of the plate 41 around the apertures 61. The ends 27E of tubes 27 are inserted into apertures 53A of extension tubes 53. Plates 41 and 43 the are moved toward the upper end plate 33 until the ends 53E of extension tubes 53 engage the plate 33 (See FIG. 7). The ends 27E of the tubes 27 then are mechanically expanded against the walls of the tubes 53. The manifold 35U is located with its edges against plate 41 and the tabs 39 are bent around the outside edges of the manifold 35U. Tabs 71 are bolted to other structure of the system. A similar procedure is followed in assembling the lower plates 33, 41, 43, and the lower manifold 35L to the lower ends 27E of the tubes 27. FIG. 7 shows the complete assembled heat exchanger incorporating the seal plates 41, 43.

Thus the seal plates 41 and 43 provide an effective and easy to assemble seal between the outside surfaces of the ends of the oval shaped tubes 27 and the manifolds 35U and 35L.

I claim:

1. A heat exchanger, comprising:

a core comprising a plurality of plate like metal fins located generally parallel to each other, each of said fins having a plurality of spaced apart oval shaped apertures formed therethrough with each fin having each aperture aligned with a corresponding aperture of an adjacent fin such that a plurality of spaced apart aligned apertures extend through said plurality of fins, a plurality of oval shaped metal flow tubes extending through said plurality of spaced apart aligned apertures respectively with said flow tubes having end portions extending beyond an end of said core, a manifold with port means coupled to said end of said core to allow fluid flow between said end portions of said tubes and said port means of said manifold, seal means located between said end of said core and said manifold to form a seal therebetween, said seal means comprising:

a first plastic plate member having a plurality of spaced apart oval shaped apertures formed therethrough equal in number to the number of said flow tubes and located to tightly receive said end portions of said flow tubes respectively and also having a plurality of spaced apart oval shaped extension tubes extending from one side of said first plastic plate member from said oval shaped apertures of said first plastic plate member respectively for tightly receiving said flow tubes, and a second plastic plate member having a plurality of oval shaped apertures formed therethrough equal in number to said extension tubes for tightly receiving said plurality of extension tubes respectively.

* * * * *